US005078616A

United States Patent [19]

Nemcovsky

[11] Patent Number: 5,078,616

[45] Date of Patent: Jan. 7, 1992

[54] ELECTRICAL CONNECTOR

[75] Inventor: Rhonda L. Nemcovsky, Warren, Pa.

[73] Assignee: GTE Products Corporation, Stamford, Conn.

[21] Appl. No.: 695,836

[22] Filed: May 6, 1991

[51] Int. Cl.[5] ..... H01R 4/24

[52] U.S. Cl. ..... 439/404

[58] Field of Search ..... 439/389–425

[56] References Cited

U.S. PATENT DOCUMENTS 4,278,314 7/1981 Moser et al. ..... 439/404

4,679,880 7/1987 Pitsch ..... 439/404

*Primary Examiner*—Joseph H. McGlynn

*Attorney, Agent, or Firm*—William H. McNeill

[57] ABSTRACT

A connector for use with one or more multiple wire structures which include at least three wires. The connector includes a lower housing which cooperates with an upper stress relief housing component to provide strain relief for each multiple wire structure sandwiched therebetween. The lower housing also provides recesses for a plurality of first electrical connectors each of which includes two contacts for electrically engaging lower portions of a respective first and second wire of a multiple wire structure, and for a plurality of second electrical connectors each of which electrically engages a respective third wire of the multiple wire structure. An upper housing component is also provided which includes recesses for a plurality of third electrical connectors each of which include two contacts for electrically engaging upper portions of a respective first and second wire of the multiple wire structure so that each first and second wire is sandwiched between two contacts of a first electrical connector and two contacts of a third electrical connector.

15 Claims, 4 Drawing Sheets

ELECTRICAL CONNECTOR

CROSS REFERENCE TO RELATED APPLICATION

Cross reference is hereby made to related application Ser. No. 07/679,386 filed on Apr. 2, 1991 for Connector and naming Rhonda L. Nemcovsky as inventor.

BACKGROUND OF THE INVENTION

1. Field of the Invention

The present invention relates to an electrical connector which can be connected to an insulated or non-insulated multiple wire cable to mate wires thereof.

2. Description of the Prior Art

Connectors for use with multiple wire cables are known. For example, in a typical trilead cable, it is known to assemble a connector thereto by first stripping the cable insulation to expose three wires which include the signal wire and two ground wires. The wires are then connected to two contacts. In particular, one contact is connected to the signal wire and one contact is connected to both of the ground wires. Such connections are effected by crimping in the usual manner. Subsequently, the contacts are disposed into a plastic housing and heat staked in position to form a subassembly. Finally, a strain relief member and a handle are molded to the subassembly. Such fabrication is relatively costly in that it is very labor intensive.

It is an object of the present invention to provide a multi-wire connector the fabrication of which is less labor intensive than heretofore.

It is a further object of the present invention to provide such a connector requiring fewer components and assembly operations than heretofore.

It is also an objective of the present invention to provide such a connector wherein the components of the assembly can be held together by snap-fit latches so that the assembly can be repaired by disassembling the components, replacing damaged contacts and reassembling the components.

A further objective of the present invention is to provide such a connector wherein a strain relief component can incorporate a handle to aid in disconnecting the assembly.

Another objective of the present invention is to provide such a connector wherein contacts are contained in one component which when assembled with a strain relief component serve to align the cables.

It is also an objective of the present invention to provide such a connector wherein mass termination of the cable is possible.

SUMMARY OF THE INVENTION

This invention achieves these and other results by providing a connector for use with one or more multiple wire structures each of which comprises at least three wires. The connector includes a lower housing component comprising an upper surface and a lower surface. A channel is disposed in the upper surface and extends in a first direction from a first edge of the lower housing component to an opposite second edge of the lower housing component. At least one first alignment recess is disposed in the upper surface and extends in a second direction from a third edge of the lower housing component to the channel. At least one first connector receiving recess is disposed in the upper surface and extends in the second direction from an opposite fourth edge of the lower housing component towards the channel. At least one lower connector means is provided each of which is positioned within the channel and includes at least one lower first contact for electrically engaging a lower surface of a respective first wire and at least one lower second contact electrically coupled to, and positioned to provide a lower open area relative to, the lower first contact for electrically engaging a lower surface of a respective second wire. Each lower first contact and lower second contact extends away from the lower surface of the lower housing component. At least one second lower connector means is provided which includes a third contact for electrically engaging a surface of a respective third wire. Each second lower connector means is positioned within a first connector receiving recess and each third contact extends away from the lower surface of the lower housing component. An upper stress relief housing component is provided for attachment to the lower housing component and comprises a top surface and a bottom surface. At least one second alignment recess is disposed in the bottom surface for mating with a first alignment recess when the upper stress relief housing component is attached to the lower housing component to provide strain relief for any multiple wire structure disposed within a first alignment recess. An upper housing component is provided for attachment to the lower housing component and comprises a first surface and an opposite second surface. At least one second connector receiving recess is disposed between the first surface and the opposite second surface of the upper housing component for securing an upper connector means positioned within a second connector receiving means. At least one upper connector means is provided each of which is positioned within at least one second connector receiving recess and includes at least one upper first contact for electrically engaging an upper surface of a respective first wire, and at least one upper second contact electrically coupled to, and positioned to provide a upper open area relative to, the upper first contact for electrically engaging an upper surface of a respective second wire. Each upper first contact and upper second contact extends away from the opposite second surface of the upper housing component. The components of the connector of the present invention are fabricated from the usual metal contact material and plastic housing material known in the art.

BRIEF DESCRIPTION OF THE DRAWINGS

This invention may be clearly understood by reference to the attached drawings in which.

DESCRIPTION OF THE PREFERRED EMBODIMENT

Figure 1:
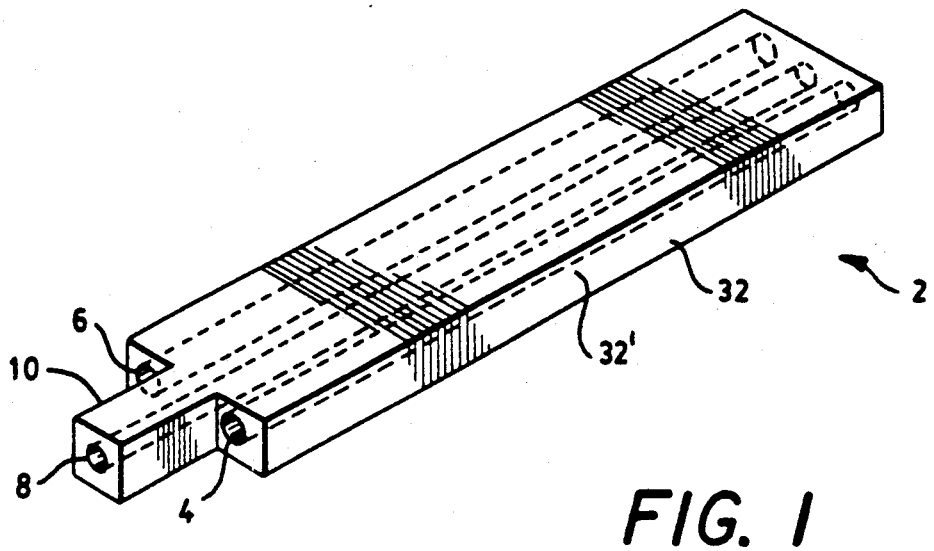
FIG. 1 is a view of an insulated multiple wire structure for use with the present invention.

The embodiment of this invention which is illustrated in the drawings is particularly suited for achieving the objects of this invention. The present invention is for use with a multiple wire structure which includes at least three wires. For example, FIG. 1 depicts an insulated multiple wire cable 2 including a first wire 4, second wire 6 and third wire 8. Typical of such a multiple wire cable is a standard flat cable or a trilead cable wherein wires 4 and 6 provide ground leads and wire 8 provides a signal lead. The multiple wire cable 2 includes insulation 10. Alternatively, such insulation may be removed for direct access to the various constituent wires.

Figure 2:
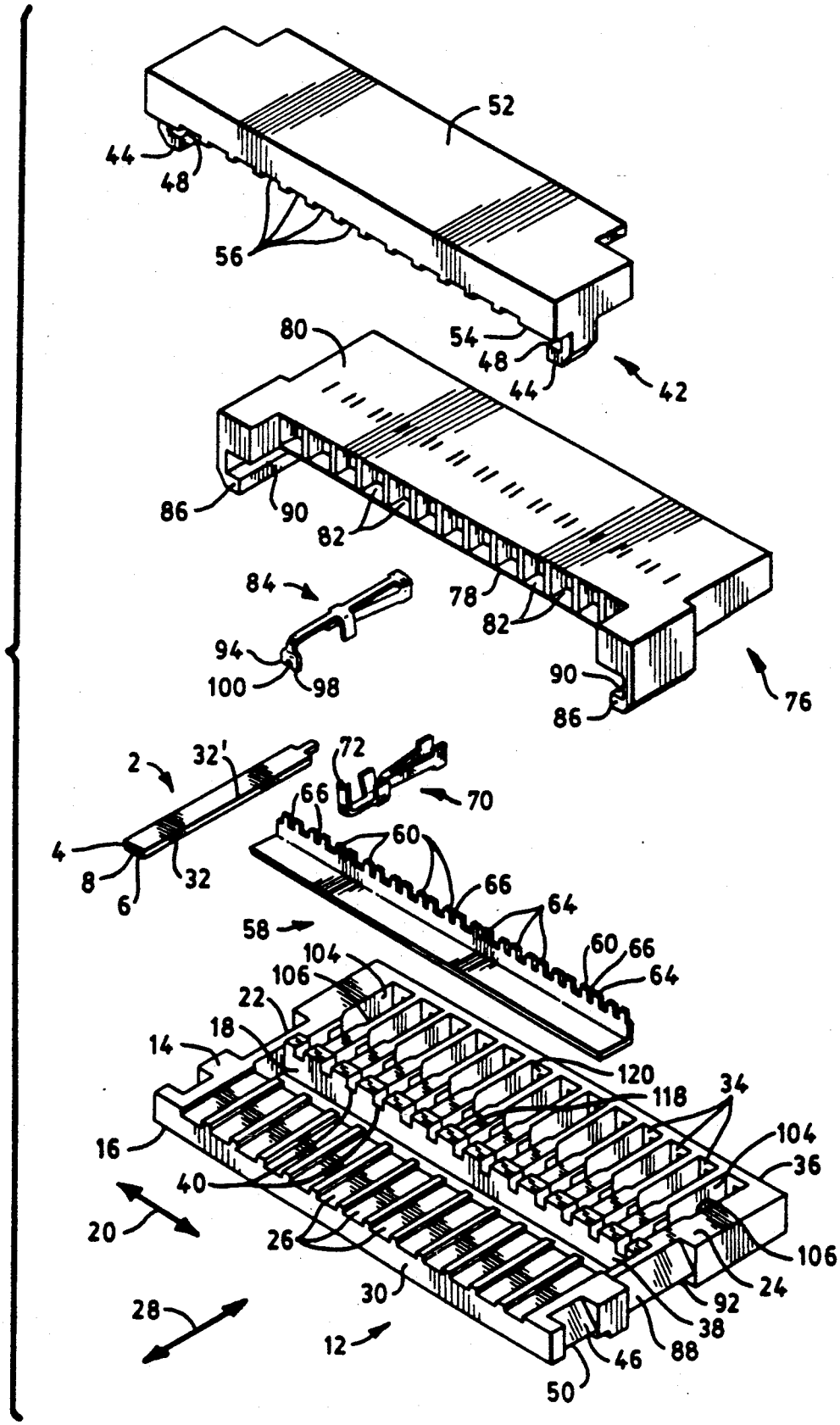
FIG. 2 is an exploded view of the preferred embodiment of the present invention.
Figure 3:
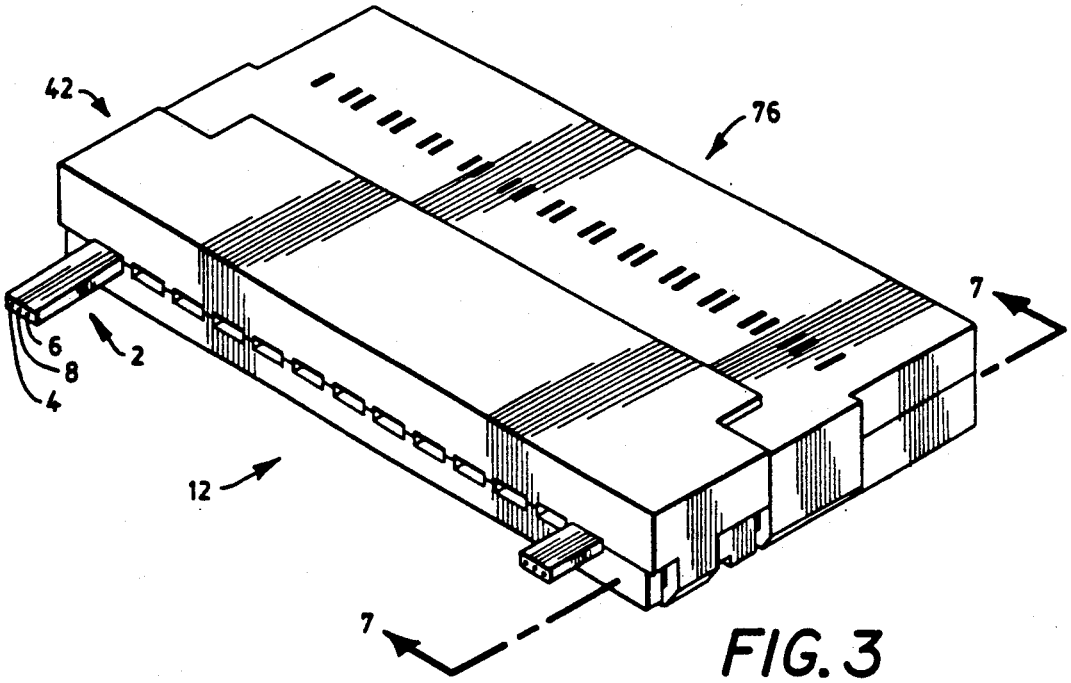
FIG. 3 is an assembled view of the embodiment of FIG. 2.

The connector of the present invention is depicted in FIGS. 2 to 7. FIGS. 2 and 3 depict a lower housing component 12 having an upper surface 14 and a lower surface 16. A channel 18 is disposed in the upper surface 14. Channel 18 extends in a first direction designated by arrow 20 from a first edge 22 of the lower housing component to an opposite second edge 24. At least one first alignment recess 26 is disposed in the upper surface 14. First alignment recess 26 extends in a second direction designated by arrow 28 from a third edge 30 of the lower housing component 12 to the channel 18. Preferably, the second direction 28 is disposed at 90° relative to the first direction 20 so that the first alignment recess 26 will be perpendicular to the length of the channel 18 as depicted in FIG. 2. In the preferred embodiment, there is a plurality of first alignment recesses 26 as depicted in FIG. 2. A respective multiple wire cable 2 may be inserted into a respective first alignment recess 26 as depicted in FIGS. 2 and 3, each first alignment recess being configured to receive a lower portion 32 of such multiple wire cable 2 which will therefore also extend in the direction of arrow 28.

At least one first connector receiving recess 34 is disposed in the upper surface 14 of the lower housing component 12. First connector receiving recess 34 extends in the direction designated by arrow 28 from a fourth edge 36, which is opposite third edge 30, towards the channel 18. In the preferred embodiment there is a plurality of first connector receiving recesses 34 as depicted in FIG. 2. An intermediate wall 38 is disposed between channel 18 and first connector receiving recesses 34. The wall 38 extends in the direction of arrow 20 from edge 22 to edge 24 and includes at least one opening 40 which extends in the direction of arrow 28 from channel 18 to a first connector receiving recess 34. Each opening 40 is dimensioned to receive a third wire 8 as described herein.

The connector of the present invention also includes an upper stress relief housing component 42 for attachment to the lower housing component 12 by means of snap-fit members 44. In order to attach component 42 to component 12, the component 42 is urged downward when viewing FIG. 2 such that members 44 are cammed away from each other by camming surfaces 46 (only one is shown) which are provided at edges 22 and 24 of the lower housing component 12. Members 44 are resilient and therefore snap back towards each other to embrace the lower housing component 12 when the edges 48 of the snap-fit members 44 are urged downward beyond edges 50 (only one is shown) of the camming surfaces 46. The upper stress relief housing component 42 includes a top surface 52 and an opposite bottom surface 54. At least one second alignment recess 56 is disposed in the surface 54. Preferably there is a plurality of such second alignment recesses 56 as depicted in FIG. 2. Each recess 56 is configured to receive an upper portion 32' of a multiple wire cable 2 when the upper stress relief housing component 42 is attached to the lower housing component 12 to sandwich a cable 2 therebetween. To this end, each first alignment recess 26 is a mirror image of each second alignment recess 56 when components 12 and 42 are attached to one another as described herein.

Figure 4:
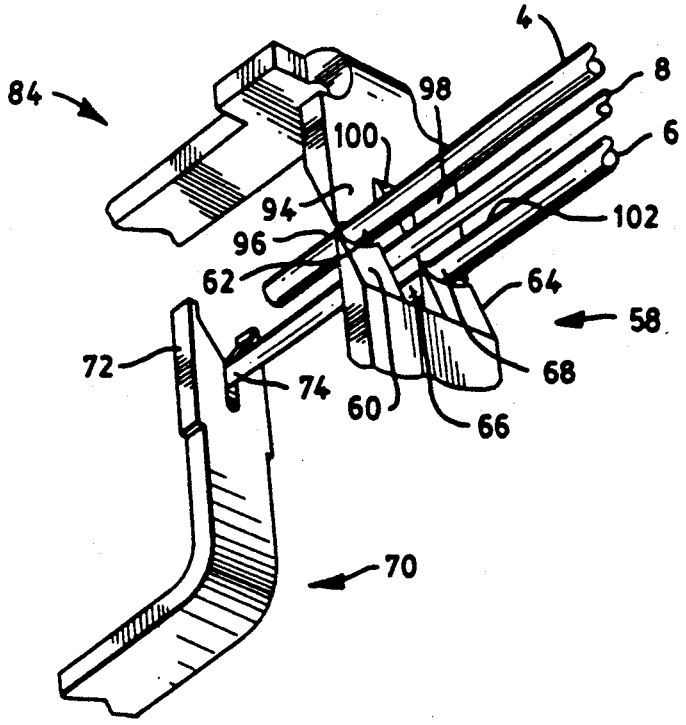
FIG. 4 is a view of contacts engaging wires in accordance with the present invention.

At least one first lower connector mean 58 is positioned within channel 18. As depicted in FIGS. 2 and 4, lower connector means 58 includes at least one lower first contact 60 for electrically engaging a lower surface 62 of a respective first wire 4 and at least one lower second contact 64 electrically coupled to, and positioned to provide a lower open area 66 relative to, the lower first contact 60 for electrically engaging a lower surface 68 of a respective second wire 6. As depicted in FIG. 2, each lower first contact 60 and lower second contact 64 will extend away from the lower surface 16.

A second lower connector means 70 is positioned within at least one respective first connector receiving recess 34. Each second lower connector means 70 includes a third contact 72 for electrically engaging a surface 74 of a respective third wire 8 as depicted in FIG. 4 As depicted in FIG. 2, each second lower connector means 70 extends away from the lower surface 16.

An upper housing component 76 is provided for attachment to the lower housing component 12. The upper housing component 76 includes a first surface 78 and an opposite second surface 80. At least one second connector receiving recess 82 is provided between surfaces 78 and 80 for securing an upper connector means 84 positioned therein. The upper housing component 76 is provided for attachment to lower housing compartment 12 by means of snap-fit members 86 which operate in a manner similar to snap-fit members 44. In particular, component 76 is urged downward when viewing FIG. 2 such that resilient members 86 are cammed away from each other by camming surfaces 88 (only one is shown) until they snap back towards each other to embrace the lower housing component 12 when the edges 90 are urged downward beyond edges 92 (only one is shown).

An upper connector means 84 is positioned within at least one second connector receiving recess 82. As depicted in FIGS. 2 and 4, each upper connector means 84 includes at least one upper first contact 94 for electrically engaging an upper surface 96 of a respective first wire 4, and at least one upper second contact 98 electrically coupled to, and positioned to provide an upper open area 100 relative to, the upper first contact 94 for electrically engaging an upper surface 102 of a respective second wire 6. As depicted in FIG. 2, each upper first contact 94 and each upper second contact 98 will extend away from the surface 80.

Figure 5:
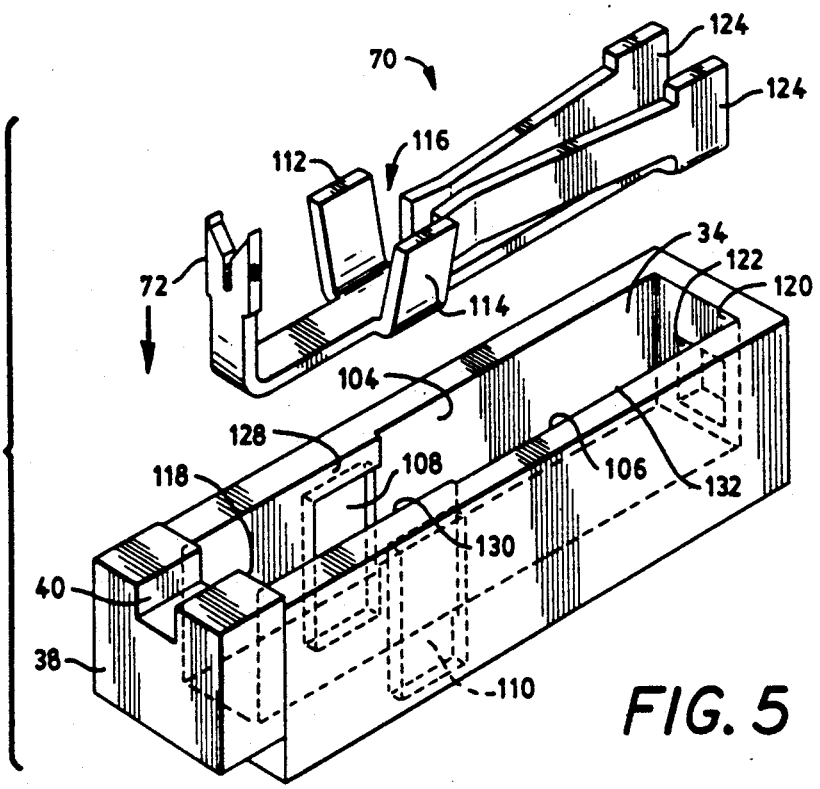
FIG. 5 is an exploded schematic view illustrating features of the embodiment of FIG. 2.
Figure 7:
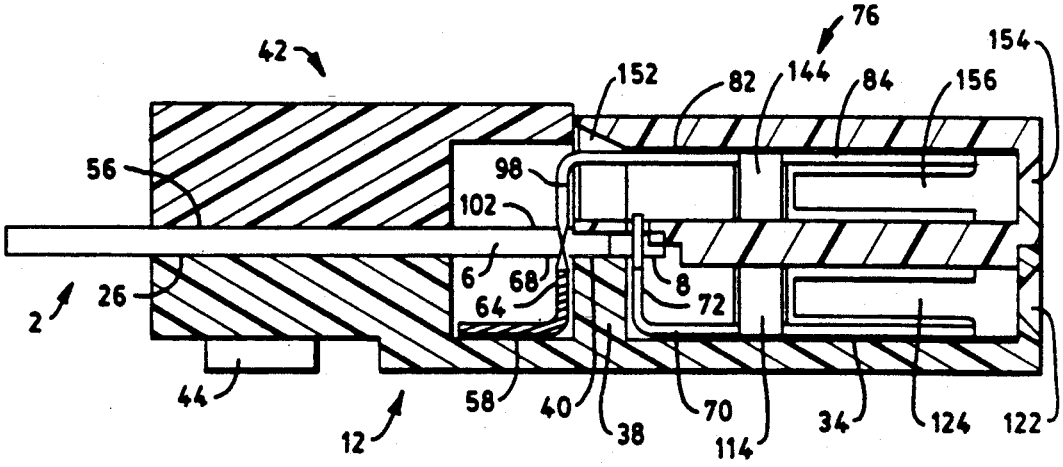
FIG. 7 is a cross-sectional view taken along lines 7—7 in FIG. 3.

In the preferred embodiment each first connector receiving recess 34 includes opposing first and second boundary walls 104, 106 each of which includes first slots 108, 110 as depicted schematically in FIG. 5. Slots 108, 110 register with and thereby serve to retain corresponding resilient legs 112, 114 of a U-shaped retaining segment 116 of each respective second lower connector means 70 positioned within a first connector receiving recess 34. In the preferred embodiment, each first connector receiving recess 34 also includes opposing third and fourth boundary walls 118, 120. The boundary wall 118 is formed by the intermediate wall 38. The opposing boundary wall 120 includes a first access opening 122 which extends therethrough to a first terminal 124 which is electrically connected to a third contact 72 of each respective second lower connector means 70 positioned within a first connector receiving recess 34. In the preferred embodiment each boundary surface 104, 106 includes a camming portion 128, 130 adjacent a respective first slot 108, 110. Each camming portion 128, 130 is also adjacent the opening 132 to each first connector receiving recess 34. With reference to FIGS. 5 and 7, a second lower connector means 70 can be positioned within a recess 34 by inserting the connector means downwardly into opening 132 so that resilient legs 112, 114 are cammed by respective camming portions 128, 130 and caused to snap into respective slots 108, 110. In such position, the terminal 124 will be adjacent to access opening 122 and the third contact 72 will be adjacent to an opening 40 through which a third wire 8 will extend when the cable 2 is positioned between respective alignment recesses 26 and 56. In the preferred embodiment, the distance between the bases of slots 108 and 110 will be less than the distance between the outer ends of the legs 112 and 114. In this manner, when the connector means 70 is positioned within the recess 34, the resilient legs 112, 114 will be urged against the base of slots 108 and 110 to firmly hold the connector means 70 in place.

Figure 6:
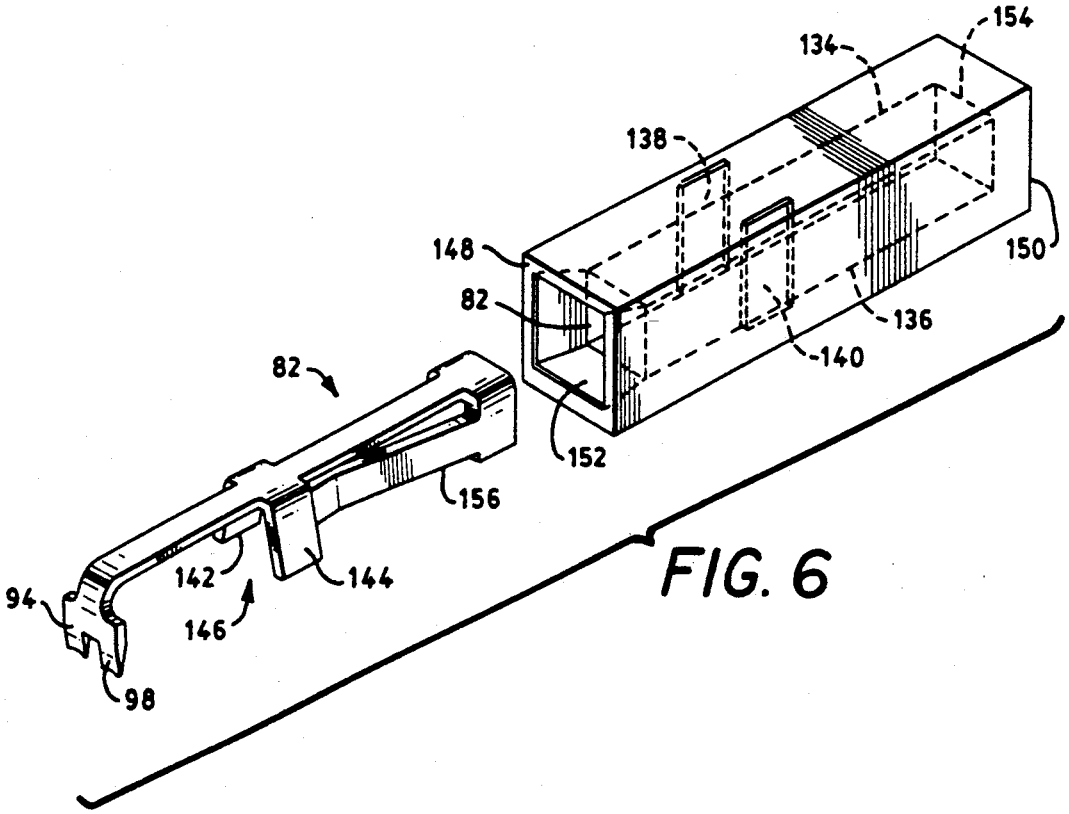
FIG. 6 is an exploded schematic view illustrating other features of the embodiment of FIG. 2.

In the preferred embodiment, each second connector receiving recess 82 includes opposing first and second confirming walls 134, 136 as schematically depicted in FIG. 6. Each wall 134, 136 includes a respective second slot 138, 140 which registers with and retains corresponding resilient legs 142, 144 of a U-shaped retaining segment 146 of a respective upper connector means 84 positioned within the second connector receiving recess 82.

In the preferred embodiment each second connector receiving recess 82 includes opposing third and fourth confining walls 148, 150 as depicted schematically in FIG. 6. The third confining wall 148 includes an aperture 152 which extends therethrough and is disposed above the intermediate wall 38 when the upper housing component 76 is attached to the lower housing component 12 as depicted in FIG. 7. As shown in FIGS. 6 and 7, such arrangement permits an upper connector means 84 to extend out of the second connector receiving recess 82 so that the upper second contact 98 can electrically engage upper surface 102 of a respective second wire 6 as described herein. In a similar manner, the upper first contact 94 can electrically engage upper surface 96 of a respective first wire 4. The fourth confining wall 150 includes a second access opening 154 which extends therethrough to a second terminal 156 which is electrically connected to an upper first contact 94 and an upper second contact 98 of a respective upper connector means 84 positioned within the second connector receiving recess 82. Preferably, the distance between the base portion of each second slot 138, 140 is less than the distance between the outer ends of legs 142, 144 of the U-shaped retaining segment 146 of each respective upper connector means 84. In this manner, when the connector means 84 is positioned within the recess 82, the resilient legs 142, 144 will be urged against the base of slots 138, 140 to firmly hold the connector means 84 in place.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector for use with one or more multiple wire structures each of which comprises at least three wires, comprising:

a lower housing component comprising an upper surface and a lower surface, a channel disposed in said upper surface and extending in a first direction from a first edge of said lower housing component to an opposite second edge of said lower housing component, at least one first alignment recess disposed in said upper surface and extending in a second direction from a third edge of said lower housing component to said channel, and at least one first connector receiving recess disposed in said upper surface and extending in said second direction from an opposite fourth edge of said lower housing component towards said channel;

at least one first lower connector means each of which is positioned within said channel and including at least one lower first contact for electrically engaging a lower surface of a respective first wire, and at least one lower second contact electrically coupled to, and positioned to provide a lower open area relative to, said lower first contact for electrically engaging a lower surface of a respective second wire each lower first contact and lower second contact extending away from said lower surface;

at least one second lower connector means including a third contact for electrically engaging a surface of a respective third wire, each second lower connector means being positioned within a first connector receiving recess and each third contact extending away from said lower surface;

an upper stress relief housing component for attachment to said lower housing component and comprising a top surface and a bottom surface, at least one second alignment recess disposed in said bottom surface for mating with a first alignment recess when said upper stress relief housing component is attached to said lower housing component to provide strain relief for any of said multiple wire structure disposed within a first alignment recess;

an upper housing component for attachment to said lower housing component and comprising a first surface and an opposite second surface, at least one second connector receiving recess disposed between said first surface and said opposite second surface for securing an upper connector means positioned within a second connector receiving recess; and at least one upper connector means each of which is positioned within at least one second connector receiving recess and including at least one upper first contact for electrically engaging an upper surface of a respective first wire, and at least one upper second contact electrically coupled to, and positioned to provide an upper open area relative to, said upper first contact for electrically engaging an upper surface of a respective second wire, each upper first contact and upper second contact extending away from said opposite second surface.

2. The connector of claim 1 wherein said lower housing component includes an intermediate wall disposed between said channel and said at least one first connector receiving recess, said intermediate wall extending in said first direction from said first edge to said opposite second edge and including at least one respective opening which extends in said second direction from said channel to a respective first connector receiving recess, each opening being dimensioned to receive a third wire of a multiple wire structure.

3. The connector of claim 2 wherein said at least one first alignment recess includes a plurality of first alignment recesses, each recess of said plurality of first alignment recesses being configured to receive a lower portion of a respective multiple wire structure which extends in said second direction.

4. The connector of claim 3 wherein each first connector receiving recess of said at least one first connector receiving recess includes opposing first and second boundary walls, each of said opposing first and second boundary walls including a first slot which will register with and retain corresponding resilient legs of a U-shaped retaining segment of a respective second lower connector means positioned within said first connector receiving recess.

5. The connector of claim 4 wherein each first connector receiving recess of said at least one first connector receiving recess further includes opposing third and fourth boundary walls, said third boundary wall being formed by said intermediate wall and said fourth boundary wall including a first access which extends therethrough to any first terminal which is electrically connected to a third contact of a respective second lower connector means positioned within said first connector receiving recess.

6. The connector of claim 5 wherein each opposing first and second boundary surface includes a camming portion adjacent a respective first slot, each camming portion also being adjacent an opening to said first connector receiving recess.

7. The connector of claim 6 wherein the distance between a base portion of each respective first slot is less than the distance between outer ends of said legs.

8. The connector of claim 3 wherein said at least one second alignment recess includes a plurality of second alignment recesses, each recess of said plurality of second alignment recesses being configured to receive an upper portion of a respective multiple wire structure when said upper stress relief housing component is attached to said lower housing component.

9. The connector of claim 8 wherein each first alignment recess is a mirror image of each second alignment recess when said upper stress relief housing component is attached to said lower housing component.

10. The connector of claim 4 wherein each second connector receiving recess of said at least one second connector receiving recess includes opposing first and second confining walls, each of said opposing first and second confining walls including a second slot which will register with and retain corresponding resilient legs of a U-shaped retaining segment of a respective upper connector means positioned within said second connector receiving recess.

11. The connector of claim 10 wherein each second connector receiving recess of said at least one second connector receiving recess further includes opposing third and fourth confining walls, said third confining wall including an aperture extending therethrough, and disposed above said intermediate wall when said upper housing component is attached to said lower housing component, permitting an upper connector means to extend out of said second connector receiving recess, and said fourth confining wall including a second access opening which extends therethrough to any second terminal which is electrically connected to an upper first contact and an upper second contact of a respective upper connector means positioned within said second connector receiving recess.

12. The connector of claim 11 wherein the distance between a base portion of each respective second slot is less than the distance between outer ends of said legs of said U-shaped retaining segment of a respective upper connector means.

13. The connector of claim 12 wherein said at least one second alignment recess includes a plurality of second alignment recesses, each recess of said plurality of second alignment recesses being configured to receive an upper portion of a respective multiple wire structure when said upper stress relief housing component is attached to said lower housing component.

14. The connector of claim 13 wherein each first alignment recess is a mirror image of each second alignment recess when said upper stress relief housing component is attached to said lower housing component.

15. A connector for use with one or more multiple wire structures each of which comprises at least three wires, comprising:

a lower housing component comprising an upper surface and a lower surface, a channel disposed in said upper surface and extending in a first direction from a first edge of said lower housing component to an opposite second edge of said lower housing component, at least one first alignment recess disposed in said upper surface and extending in a second direction from a third edge of said lower housing component to said channel, and at least one first connector receiving recess disposed in said upper surface and extending in said second direction from an opposite fourth edge of said lower housing component towards said channel;

at least one first lower connector means each of which is positioned within said channel and including at least one lower first contact electrically engaging a lower surface of a respective first wire, and at least one lower second contact electrically coupled to, and positioned to provide a lower open area relative to, said lower first contact and electrically engaging a lower surface of a respective second wire, each lower first contact and lower second contact extending away from said lower surface;

at least one second lower connector means including a third contact electrically engaging a surface of a respective third wire, each second lower connector means being positioned within a first connector receiving recess and each third contact extending away from said lower surface;

an upper stress relief housing component removeably attached to said lower housing component and comprising a top surface and a bottom surface, at least one second alignment recess disposed in said bottom surface mating with a first alignment recess to provide strain relief for each of said multiple wire structures disposed within a first alignment recess;

an upper housing component removeably attached to said lower housing component and comprising a first surface and an opposite second surface, at least one second connector receiving recess disposed between said first surface and said opposite second surface for securing an upper connector means positioned within a second connector receiving recess; and at least one upper connector means positioned within a second connector receiving recess and including at least one upper first contact electrically engaging an upper surface of a respective first wire, and at least one upper second contact electrically coupled to, and positioned to provide an upper open area relative to, said upper first contact and electrically engaging an upper surface of a respective second wire, each upper first contact and upper second contact extending away from said opposite second surface.

* * * * *